US008734716B2

(12) United States Patent
Harada et al.

(10) Patent No.: US 8,734,716 B2
(45) Date of Patent: May 27, 2014

(54) HEAT-RESISTANT SUPERALLOY

(75) Inventors: Hiroshi Harada, Ibaraki (JP); Yuefeng Gu, Ibaraki (JP); Chuanyong Cui, Ibaraki (JP); Makoto Osawa, Ibaraki (JP); Akihiro Sato, Ibaraki (JP); Toshiharu Kobayashi, Ibaraki (JP)

(73) Assignee: National Institute for Materials Science, Ibaraki (JP)

( * ) Notice: Subject to any disclaimer, the term of this patent is extended or adjusted under 35 U.S.C. 154(b) by 51 days.

(21) Appl. No.: 13/045,968

(22) Filed: Mar. 11, 2011

(65) Prior Publication Data

US 2011/0194971 A1 Aug. 11, 2011

Related U.S. Application Data

(63) Continuation of application No. 11/792,263, filed as application No. PCT/JP2005/022598 on Dec. 2, 2005, now abandoned.

(30) Foreign Application Priority Data

Dec. 2, 2004 (JP) ..... 2004-350166

(51) Int. Cl.

| | |
|---|---|
| ***C22C 19/07*** | (2006.01) |
| ***C22C 19/05*** | (2006.01) |
| ***C22C 30/00*** | (2006.01) |

(52) U.S. Cl.
USPC ..... 420/438; 420/446; 420/588; 420/450; 420/447; 420/449

(58) Field of Classification Search
USPC ..... 420/445–449, 438, 588, 450; 148/428
See application file for complete search history.

(56) References Cited

U.S. PATENT DOCUMENTS

| | | | | |
|---|---|---|---|---|
| 2,809,110 | A | 10/1957 | Darmara | |
| 3,869,284 | A * | 3/1975 | Baldwin | 420/447 |
| 4,140,555 | A | 2/1979 | Garcia et al. | |
| 5,637,159 | A * | 6/1997 | Erickson | 148/410 |

FOREIGN PATENT DOCUMENTS

| | | |
|---|---|---|
| JP | 2000-64005 | 2/2000 |
| JP | 2000-204426 | 7/2000 |

OTHER PUBLICATIONS

International Search Report issued Mar. 7, 2006 in International (PCT) Application No. PCT/JP2005/022598.

* cited by examiner

*Primary Examiner* — Jessee Roe
(74) *Attorney, Agent, or Firm* — Wenderoth, Lind & Ponack, L.L.P.

(57) ABSTRACT

Disclosed is a novel heat-resistant superalloy for turbine disks having a chemical composition consisting of, in mass %, 19.5-55% of cobalt, 2-25% of chromium, 0.2-7% of aluminum, 3-15% of titanium and the balance of nickel and inevitable impurities.

7 Claims, 10 Drawing Sheets

(1)U720Li (2) Alloy C (a) U720LI (b) Alloy 2

(a) Before testing (b) After 1000 hours at 750°C (a) Before testing (b) After 1000 hours at 750°C (a) Composition 25 (b) Alloy 7 (c) Alloy 8

HEAT-RESISTANT SUPERALLOY

This application is a continuation application of application Ser. No. 11/792,263, filed Mar. 7, 2008, now abandoned, which is a 371 Application of PCT/JP2005/022598, filed Dec. 2, 2005.

TECHNICAL FIELD

The present invention relates to a heat-resistant superalloy used for heat-resistant members of aircraft engines, power-generating gas turbines, etc., particularly turbine disks and blades.

BACKGROUND ART

Heat-resistant members of aircraft engines, power-generating gas turbines, etc., for example, turbine disks are parts holding rotor blades and rotating at a high speed and require a material which can withstand a very high centrifugal stress and is excellent in fatigue strength, creep strength and fracture toughness. On the other hand, an improvement in fuel consumption and performance calls for an improvement in engine gas temperature and a reduction in weight of turbine disks and thereby requires a material of still higher heat resistance and strength.

Nickel-based forged alloys are generally employed for turbine disks. For example, there are widely used Inconel 718 having a γ" (gamma double prime) phase as a strengthening phase and Waspaloy having as a strengthening phase about 25% by volume of a precipitated γ' (gamma prime) phase which is more stable than the γ" phase.

In view of a tendency toward a higher temperature, Udimet720 which had been developed by Special Metals was introduced in 1986. Udimet720 is an alloy having about 45% by volume of a precipitated γ' phase, containing tungsten to strengthen the solid solution of the γ' phase and having a particularly excellent heat-resistant property. However, as a TCP (topologically close packed) phase which is low in structural stability and harmful is formed in Udimet720 during its use, Udimit720Li (U720Li/U720LI) improved by e.g. a reduction of chromium was developed. However, a TCP phase is formed in Udimit720Li, too, and restricts its use for a long time or at a high temperature. It is also pointed out that Udimit720 and 720Li have a narrow process window for e.g. hot working or heat treatment because of a small difference between their γ' solidus temperature (solvus) and initial melting temperature. Accordingly, it is a practical problem that the manufacture of a homogeneous turbine disk by a casting and forging process is difficult.

Powder metallurgical alloys, such as AF115, N18 and Rene88DT, are sometimes used for high-pressure turbine disks of which high strength is required. The powder metallurgical alloys have the advantage of being able to make homogeneous disks having no segregation, even though they contain many strengthening elements. On the other hand, a high level of control of the manufacturing process, including vacuum melting with high purity and the selection of a proper mesh size for powder classification, is required to prevent the mixing of inclusions and presents a problem of cost increase.

Numerous proposals have hitherto been made for improvements in the chemical compositions of nickel-based heat-resistant superalloys, and all of them contain cobalt, chromium, molybdenum or molybdenum and tungsten, aluminum and titanium as their principal constituent elements, and typical ones contain niobium or tantalum or both as their essential constituents. In the composition as described, the presence of niobium and tantalum is suitable for powder metallurgy as described above, but is a factor making casting and forging difficult. Cobalt is contained in a relatively high proportion, but JP-A-10-46278 of the application by Rolls Royce, for example, states that it does not produce any particularly significant result, and while it is generally considered to bring about positive results by realizing a lower γ' solidus temperature and a widened process window, EP 1 195 446 A1 of the application by General Electric Company does not show any other result, but limits its content to 23% by weight or less by considering cost, etc., too.

On the other hand, titanium is added as it serves to strengthen the γ' phase and thereby improve tensile strength and crack propagation resistance. However, it is limited to, say, 5% by weight, since the excessive addition of titanium results in a higher γ' solidus and a harmful phase formed to disable the formation of a sound γ' structure.

Therefore, it is difficult for the existing art to provide a heat-resistant superalloy which can withstand a long time of use at a high temperature, permits casting and forging, and is very easy to manufacture.

DISCLOSURE OF THE INVENTION

Under these circumstances, it is an object of the present invention to provide a novel heat-resistant superalloy which is useful for e.g. turbine disks and blades, is excellent in a long time of heat resistance and durability at a high temperature, permits casting and forging and is very easy to manufacture.

Thus, the present invention provides a heat-resistant superalloy having a stable structure as described and realizing a high strength at a high temperature.

The inventors of the present invention have found that the positive addition of cobalt in the range of 19.5 to 55% by mass to a heat-resistant superalloy for turbine disks and blades makes it possible to suppress any harmful TCP phase and realize a high strength at a high temperature.

They have also found that the increase of titanium in a specific ratio with cobalt makes it possible to form a stable γ/γ' two-phase structure even at a high alloy concentration and realize a still higher strength at a high temperature. And the inventors have realized a heat-resistant superalloy which is very easy to manufacture, by controlling appropriately the composition of principal constituent elements, such as cobalt and titanium.

Moreover, the inventors have found that since a $Co_3Ti$ alloy has a crystal structure similar to that of the γ' phase which is a strengthening phase in a heat-resistant superalloy, and a $Co+Co_3Ti$ alloy has, therefore, a γ+γ' two-phase structure similar to that of the heat-resistant superalloy, the addition of a Co—Ti alloy having a γ+γ' two-phase structure, i.e. a $Co+Co_3Ti$ alloy to the heat-resistant superalloy forms an alloy structure which is stable even at a high alloy concentration.

The present invention has been made on the basis of those findings and is characterized by the following:

1. A heat-resistant superalloy containing on a mass % basis 19.5 to 55% of cobalt, 2 to 25% of chromium, 0.2 to 7% of aluminum and 3 to 15% of titanium, the balance of its composition being nickel and inevitable impurities.

2. The first heat-resistant superalloy as set forth above, wherein the titanium is contained in the range of 5.5 to 15% on a mass % basis.

3. The first heat-resistant superalloy as set forth above, wherein the titanium is contained in the range of 6.1 to 15% on a mass % basis.

4. Any of the first to third heat-resistant superalloys as set forth above, wherein the aluminum is contained in the range of from 0.2% to less than 2.0% on a mass % basis.

5. Any of the first to fourth heat-resistant superalloys as set forth above, wherein at least either up to 10% of molybdenum or up to 10% of tungsten is contained on a mass % basis.

6. The fifth heat-resistant superalloy as set forth above, characterized in that the molybdenum is contained in the range of less than 3% on a mass % basis.

7. The fifth heat-resistant superalloy as set forth above, wherein the tungsten is contained in the range of less than 3% on a mass % basis.

8. Any of the fifth to seventh heat-resistant superalloys as set forth above, characterized in that the cobalt is contained in the range of 23.1 to 55% on a mass % basis.

9. Any of the first to eighth heat-resistant superalloys as set forth above, characterized in that at least either up to 5% of niobium or up to 10% of tantalum is contained on a mass % basis.

10. Any of the first to ninth heat-resistant superalloys as set forth above, characterized in that its composition contains at least any of up to 2% of vanadium, up to 5% of rhenium, up to 2% of hafnium, up to 0.5% of zirconium, up to 5% of iron, up to 0.1% of magnesium, up to 0.5 of carbon and up to 0.1% of boron on a mass % basis.

11. A heat-resistant superalloy containing up to 0.05% of zirconium, up to 0.05% of carbon and up to 0.05% of boron on a mass basis.

12. A heat-resistant superalloy characterized by containing 20 to 24% of cobalt, 12 to 14.9% of chromium, 0.8 to 1.5% of tungsten, 2.5 to 3.0% of molybdenum, 0.01 to 0.10% of zirconium, 6.1 to 6.5% of titanium, 2.0 to 3.0% of aluminum, 0.01 to 0.05% of carbon and 0.01 to 0.05% of boron on a mass % basis, the balance being nickel and inevitable impurities.

13. A heat-resistant superalloy characterized by being obtained by adding a $Co+Co_3Ti$ alloy to the twelfth heat-resistant superalloy as set forth above.

14. A heat-resistant superalloy characterized by being obtained by adding a Co-20 at % Ti alloy to the twelfth heat-resistant superalloy as set forth above.

15. Any of the above heat-resistant superalloys as set forth above, characterized in that the weight % of the titanium is from 0.17×(weight % of cobalt−23)+3 to 0.17×(weight % of cobalt−20)+7, both inclusive.

16. A heat-resistant superalloy member manufactured by one or more methods of casting, forging and powder metallurgy from any of the first to fifteenth heat-resistant superalloys as set forth above.

BEST MODE FOR CARRYING OUT THE INVENTION

Figure 1:
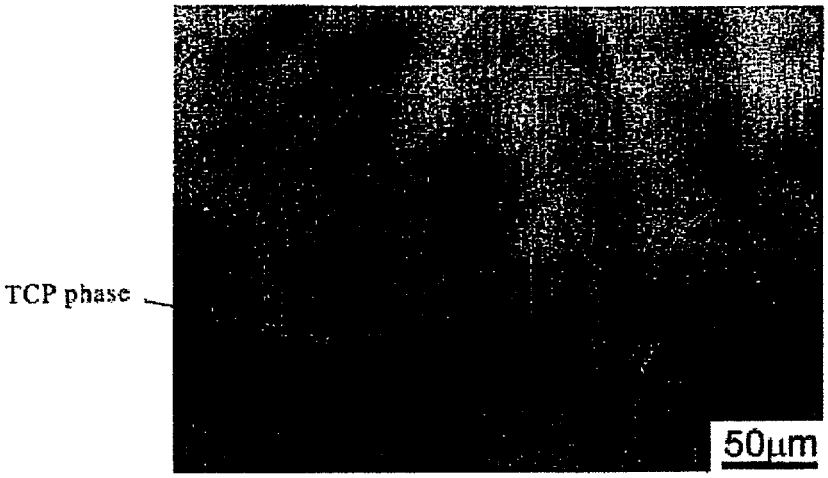
FIG. 1 shows microphotographs comparing the microstructures of heat-resistant superalloys according to the present invention and the prior art.
Figure 1:
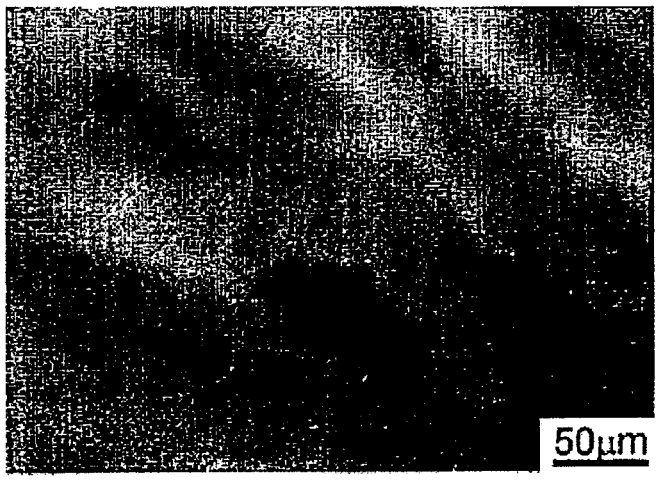

According to the present invention, cobalt is positively added in an amount not less than 19.5% by mass to suppress any TCP phase and improve strength at a high temperature. This realizes a high strength at a high temperature even if the amount of titanium may be in the range of 3 to 15% by mass. When cobalt is added with titanium, for example, as a Co—Ti alloy, 19.5% or more by mass of cobalt and 6.1% or more by mass of titanium realize a high strength at a high temperature. Similar results can be obtained from an alloy containing 25% or more by mass, or 28% or more by mass, or up to 55% by mass of cobalt. An increase of cobalt is effective for a lower γ' solidus temperature, a widened process window and improved forgeability. However, the addition of 56% or more by mass of cobalt should be avoided, since the results of a high-temperature compression test show that an alloy containing 56% or more by mass of cobalt is lower in strength up to 750° C. than an alloy known in the art.

It is necessary to add 3% or more by mass of titanium, as it strengthens γ' and brings about an improvement in strength. Its addition with cobalt realizes a still higher phase stability and higher strength, as stated above. Similar outstanding results can be obtained when its content is 6.1% or more by mass, or 6.7% or more by mass, or 7% or more by mass. It is possible to realize an alloy which is stable in structure and high in strength even at a high alloy concentration, by basically selecting a heat-resistant superalloy having a γ+γ' two-phase structure and adding a $Co+Co_3Ti$ alloy, e.g. Co-20 at % Ti, to it. However, its titanium content is limited to 15% by mass at maximum, since its titanium content exceeding 15% by mass makes prominent e.g. the formation of a η phase which is a harmful phase.

Molybdenum and tungsten are added for a stronger γ phase and an improved strength at a high temperature. Their contents in the specific ranges stated before are desirable. Any excess over the specific ranges of their contents brings about a higher density. Molybdenum is effective in the range of less than 3% by mass, for example, 2.6% or less by mass, so is tungsten in the range of less than 3% by mass, for example, 1.5% or less by mass.

Chromium is added for improved environmental resistance and fatigue crack propagation resistance. If its content is less than the specific range stated before, no desired properties can be obtained, and if it exceeds the specific range, a harmful TCP phase is formed. The chromium content is preferably 16.5% or less by mass.

Aluminum is an element forming a γ' phase and its content is controlled to the specific range stated before in order to form the γ' phase in a preferable amount.

Zirconium, carbon and boron are added in the specific ranges stated before to obtain ductility and toughness. Any excess of their contents beyond the specific ranges brings about a lower creep strength or a narrower process window.

The other elements, i.e. niobium, tantalum, rhenium, vanadium, hafnium, iron and magnesium are added in the specific ranges stated before for the same reasons as according to the prior art.

According to the present invention, it is considered preferable to see that the mass % of titanium falls within the range defined by the following expression:

From 0.17×(mass % of cobalt−23)+3 to 0.17×(mass % of cobalt−20)+7, both inclusive.

Examples embodying the invention will now be shown for its description in further detail. Of course, the invention is not limited by the following examples.

EXAMPLE 1

Alloys A to L each having the composition shown in Table 1 below were produced by melting. These alloys include alloys A to K covered by the present invention and alloy L is a comparative example having a cobalt content exceeding its range specified by the present invention.

TABLE 1

| Alloy | Cr | Ni | Co | Mo | W | Tl | Al | G | B | Zr |
|---|---|---|---|---|---|---|---|---|---|---|
| A | 14 | Bal. | 22 | 2.7 | 1.1 | 6.2 | 2.3 | 0.02 | 0.02 | 0.03 |
| B | 14 | Bal. | 25 | 2.6 | 1.1 | 6.8 | 2.1 | 0.02 | 0.02 | 0.03 |
| C | 13 | Bal. | 29 | 2.4 | 1.0 | 7.4 | 2.0 | 0.02 | 0.01 | 0.02 |
| D | 12 | Bal. | 32 | 2.3 | 0.9 | 8.0 | 1.9 | 0.02 | 0.01 | 0.02 |
| E | 11 | Bal. | 35 | 2.1 | 0.9 | 8.6 | 1.8 | 0.02 | 0.01 | 0.02 |
| F | 10 | Bal. | 39 | 2.0 | 0.8 | 9.2 | 1.6 | 0.02 | 0.01 | 0.02 |
| G | 10 | Bal. | 42 | 1.8 | 0.8 | 9.8 | 1.5 | 0.02 | 0.01 | 0.02 |
| H | 9 | Bal. | 46 | 1.7 | 0.7 | 10.4 | 1.4 | 0.01 | 0.01 | 0.02 |
| I | 8 | Bal. | 49 | 1.5 | 0.6 | 11 | 1.3 | 0.01 | 0.01 | 0.02 |
| J | 11 | Bal. | 27 | 2.1 | 0.9 | 9.0 | 2.2 | 0.02 | 0.01 | 0.03 |
| K | 15 | Bal. | 29 | 2.8 | 1.1 | 6.9 | 1.8 | 0.02 | 0.02 | 0.02 |
| L | 5 | Bal. | 63 | 0.9 | 0.4 | 13 | 0.8 | 0.01 | 0.01 | 0.01 |

Composition in weight %.

The alloy C of the present invention and the known U720Li alloy were compared in microstructure. A harmful TCP phase was observed in the U720Li alloy as heat treated at 750° C. for 240 hours, as shown in FIG. 1. On the other hand, no TCP phase was observed in the alloy C of the present invention, but its excellent structural stability was confirmed.

Compression tests were conducted on the alloys A, C, E and I of the present invention, the known U720Li alloy and the alloy L not covered by the present invention and the results thereof were compared. The results were as shown in FIGS. 2 and 3.

Figure 2:
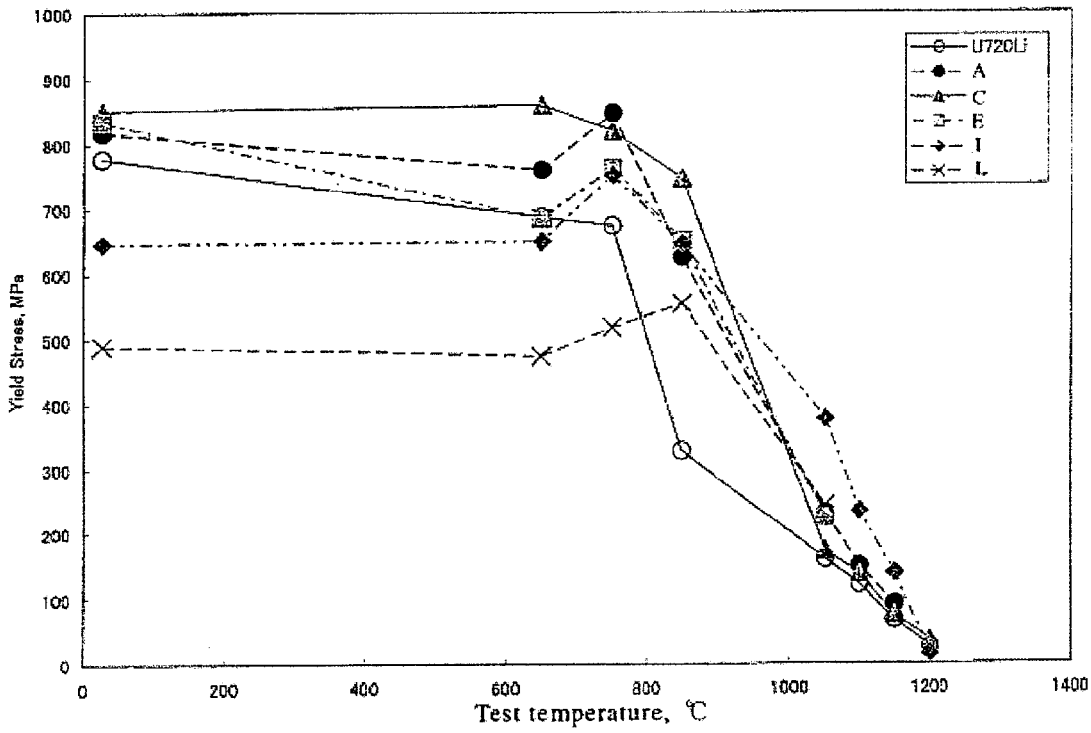
FIG. 2 is a graph showing the results of compression tests conducted on heat-resistant superalloys according to the present invention and the prior art and an alloy not covered by the present invention.

The alloys A, C, E and I of the present invention are superior to the U720Li alloy and the alloy L in high-temperature strength at 700° C. to 900° C., as shown in FIG. 2. They are by far superior to particularly the U720Li alloy. The alloys A, C, E and I of the present invention have a high strength at a high temperature in the vicinity of the range in which turbine disks are used.

On the other hand, the alloys A, C, E and I of the present invention are comparable to the known U720Li alloy in high-temperature strength at or over 1,000° C. This means that the alloys A, C, E and I of the present invention are comparable to the known U720Li alloy in deformation resistance at a forging temperature, etc., and is as easy to manufacture as the known alloy.

Figure 3:
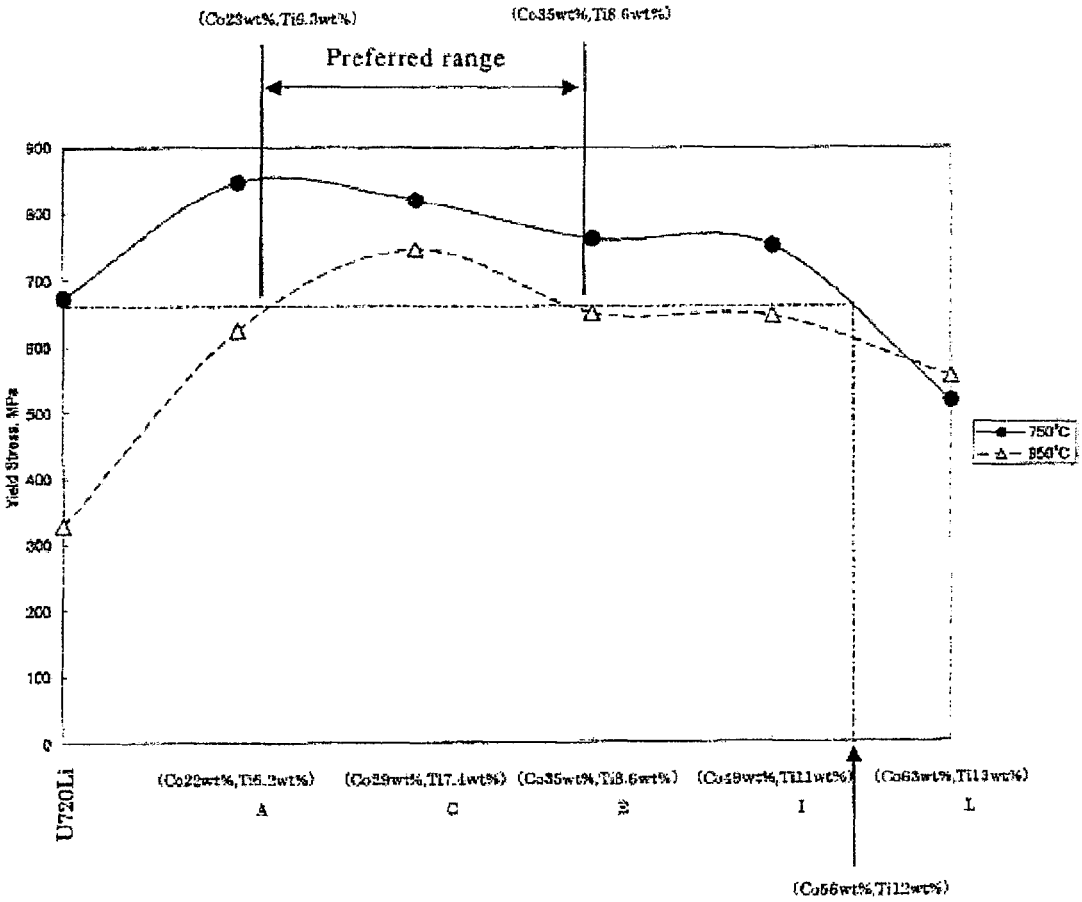
FIG. 3 is a graph showing the high-temperature strength of the heat-resistant superalloys according to the present invention and the prior art and the alloy not covered by the present invention.

It is estimated from the results of high-temperature strength as shown in FIG. 3 that an adequate cobalt content is up to 55% by mass, and that particularly preferable cobalt and titanium contents are from 23 to 35% by mass of cobalt and from 6.3 to 8.6% by mass of titanium.

EXAMPLE 2

Alloys 1 to 25 each having the composition shown in Table 2 were produced as in Example 1. The alloy 25 is a comparative alloy deviating in composition from the scope of the present invention.

TABLE 2

| Alloy | Ni | Co | Cr | Mo | W | Al | Tl | Nb | Ta | C | B | Zr |
|---|---|---|---|---|---|---|---|---|---|---|---|---|
| 1 | Bal. | 21.8 | 14.4 | 2.7 | 1.1 | 2.3 | 6.2 | — | — | 0.023 | 0.013 | 0.033 |
| 2 | Bal. | 23.3 | 16.5 | 3.1 | 1.2 | 1.9 | 5.1 | — | — | 0.026 | 0.018 | 0.022 |
| 3 | Bal. | 26.2 | 14.9 | 2.8 | 1.1 | 1.9 | 6.1 | — | — | 0.014 | 0.017 | 0.019 |
| 4 | Bal. | 26.6 | 12.8 | 2.4 | 1.0 | 2.0 | 7.4 | — | — | 0.020 | 0.013 | 0.021 |
| 5 | Bal. | 30.0 | 14.5 | 2.7 | 1.1 | 1.8 | 6.4 | — | — | 0.023 | 0.015 | 0.020 |
| 6 | Bal. | 31.0 | 15.6 | 3.0 | 1.1 | 1.6 | 5.7 | — | — | 0.025 | 0.017 | 0.022 |
| 7 | Bal. | 23.4 | 14.1 | 2.7 | 1.2 | 2.2 | 5.8 | — | — | 0.032 | 0.015 | 0.032 |
| 8 | Bal. | 24.9 | 13.8 | 2.6 | 1.1 | 2.2 | 5.7 | — | — | 0.032 | 0.014 | 0.032 |
| 9 | Bal. | 26.5 | 13.5 | 2.6 | 1.1 | 2.1 | 5.6 | — | — | 0.031 | 0.014 | 0.031 |
| 10 | Bal. | 24.6 | 16.5 | 3.1 | 1.2 | 1.8 | 5.3 | — | — | 0.029 | 0.018 | 0.022 |
| 11 | Bal. | 26.2 | 16.1 | 3.0 | 1.2 | 1.8 | 5.2 | — | — | 0.028 | 0.017 | 0.021 |
| 12 | Bal. | 27.8 | 14.6 | 2.8 | 1.1 | 1.9 | 5.9 | — | — | 0.017 | 0.017 | 0.019 |
| 13 | Bal. | 29.2 | 14.3 | 2.7 | 1.1 | 1.9 | 5.8 | — | — | 0.016 | 0.016 | 0.018 |
| 14 | Bal. | 30.0 | 12.5 | 2.4 | 1.0 | 2.0 | 7.3 | — | — | 0.029 | 0.013 | 0.021 |
| 15 | Bal. | 31.5 | 12.3 | 2.3 | 1.0 | 1.9 | 7.1 | — | — | 0.029 | 0.012 | 0.020 |
| 16 | Bal. | 24.7 | 13.7 | 2.6 | 1.1 | 2.2 | 5.6 | — | 1.0 | 0.032 | 0.014 | 0.031 |
| 17 | Bal. | 24.2 | 13.4 | 2.6 | 1.1 | 2.1 | 5.5 | — | 3.0 | 0.031 | 0.014 | 0.031 |
| 18 | Bal. | 24.7 | 13.7 | 2.6 | 1.1 | 2.2 | 5.6 | 1.0 | — | 0.032 | 0.014 | 0.031 |
| 19 | Bal. | 24.2 | 13.4 | 2.6 | 1.1 | 2.1 | 5.5 | 3.0 | — | 0.031 | 0.014 | 0.031 |
| 20 | Bal. | 26.2 | 13.4 | 2.6 | 1.1 | 2.1 | 5.5 | — | 1.0 | 0.031 | 0.014 | 0.031 |
| 21 | Bal. | 26.2 | 13.4 | 2.6 | 1.1 | 2.1 | 5.5 | 1.0 | — | 0.031 | 0.014 | 0.031 |
| 22 | Bal. | 26.0 | 16.5 | — | 2.8 | 1.8 | 5.9 | — | — | 0.032 | 0.014 | 0.031 |
| 23 | Bal. | 23.1 | 16.3 | 1.8 | — | 1.8 | 5.5 | — | — | 0.033 | 0.014 | 0.031 |
| 24 | Bal. | 28.0 | 15.5 | — | — | 2.2 | 5.8 | — | — | 0.031 | 0.013 | 0.028 |
| 25 | Bal. | 18 | 14.4 | 2.8 | 1.2 | 2.3 | 5.9 | — | — | 0.033 | 0.015 | 0.033 |

Figure 4:
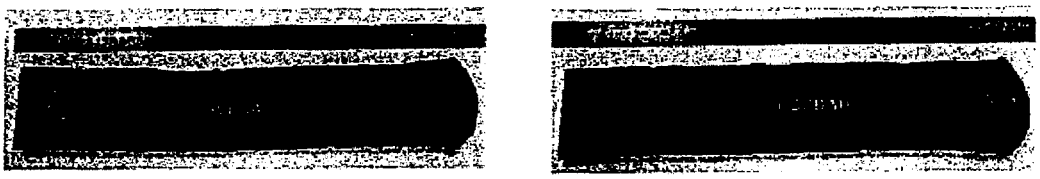
FIG. 4 gives photographs showing the outward appearance of rolled products.

FIG. 4 presents a photograph showing the outward appearance of a rolled product of the alloy 2 embodying the present invention together with that of the known U720LI. It shows a beautifully rolled product having no crack, etc., upon rolling like U720LI. Although only the alloy 2 is shown, it has been confirmed that all of the other alloys embodying the present invention are comparable or even superior to the known alloy in rollability. It is obvious that the present invention maintains rollability, while being comparable or superior to the known alloy in high strength.

Table 3 shows the results of a tensile test conducted at 750° C. on a test specimen taken from each rolled product. All of the alloys embodying the present invention showed a higher tensile strength than that of the known U720LI and an improvement of about 10% in proof strength was confirmed with the alloys 1 to 3 and 5.

TABLE 3

| Alloy | 0.2% proof strength (MPa) | Tensile strength (MPa) |
|---|---|---|
| U720LI | 888 | 1056 |
| 1 | 977 | 1140 |
| 2 | 951 | 1130 |
| 3 | 993 | 1151 |
| 5 | 950 | 1118 |
| 6 | 862 | 1124 |

Figure 5:
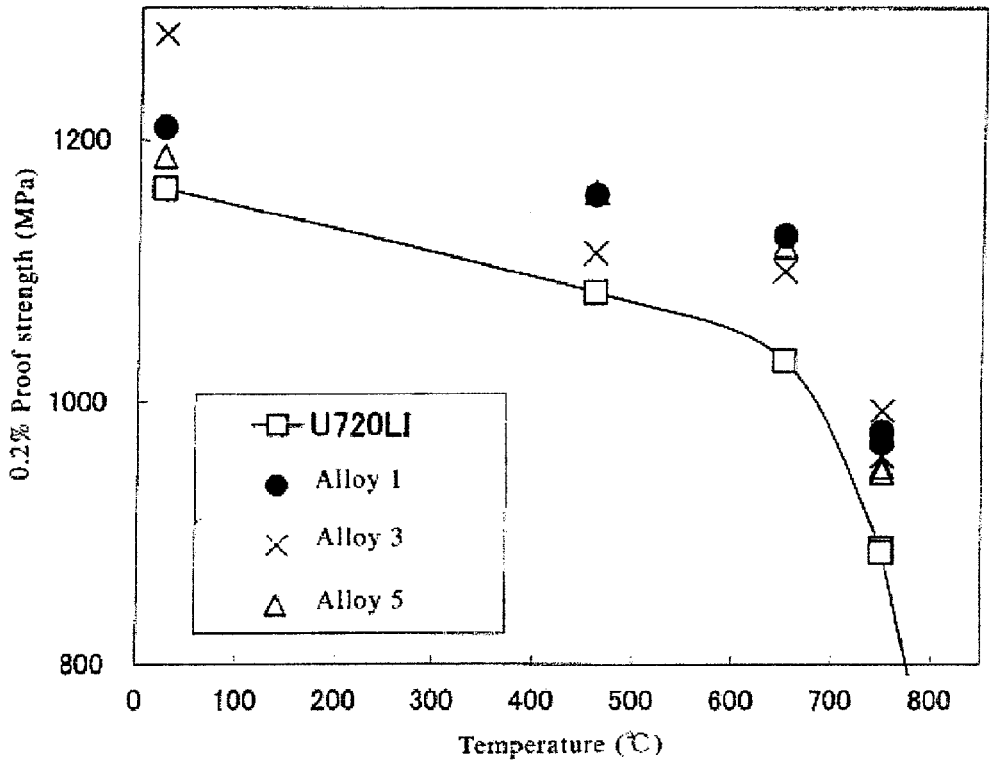
FIG. 5 is a diagram illustrating the results of tensile tests on rolled products.
Figure 6:
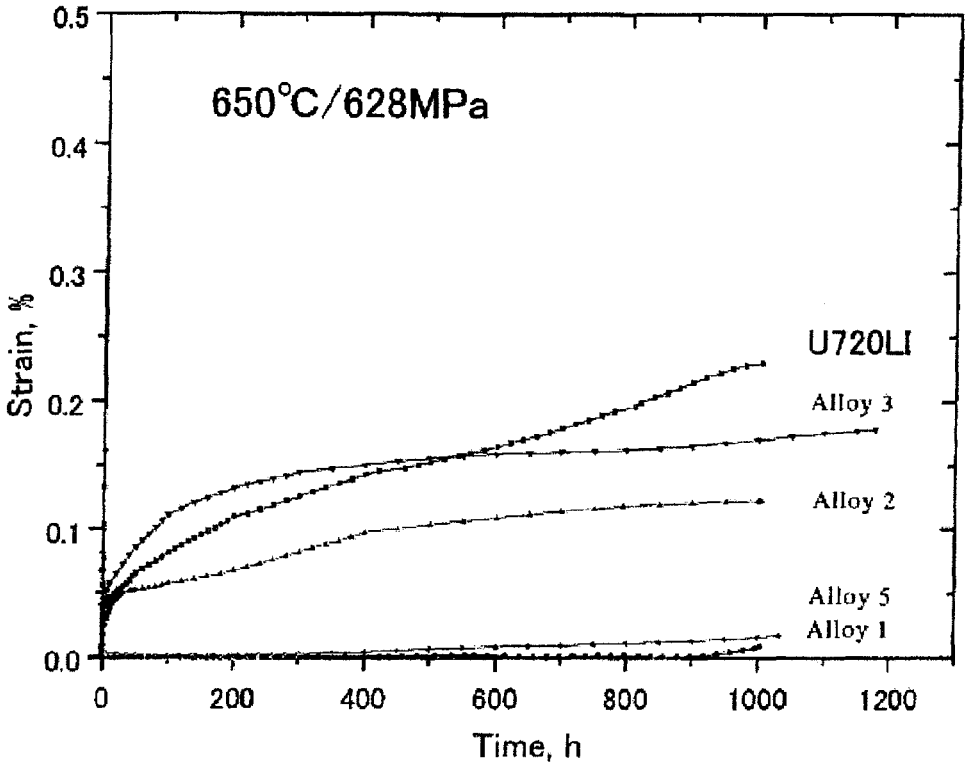
FIG. 6 is a diagram illustrating the results of creep strength tests on rolled products.

FIG. 5 presents a curve showing the creep strength of a test specimen taken from each rolled product as measured at 650° C./628 MPa over about 1,000 hours. It is obvious therefrom that the present invention has excellent creep characteristics as compared with U720LI. It is obvious that the alloys 1 and 5 show particularly excellent characteristics.

Figure 7:
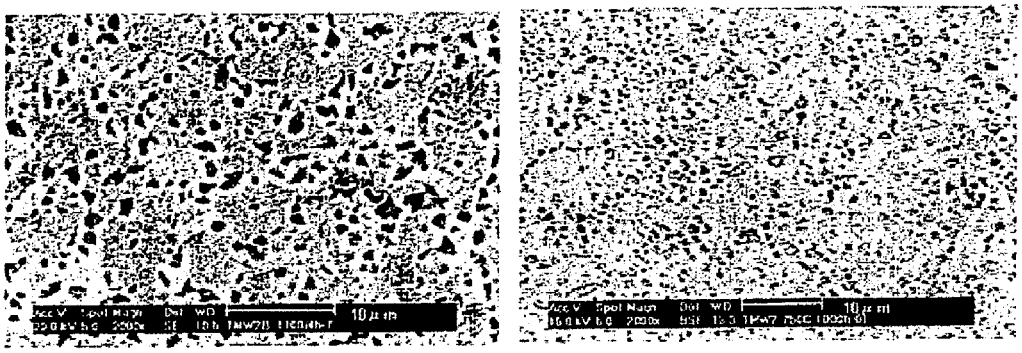
FIG. 7 gives photographs showing the microstructures of a rolled product of an alloy 1 embodying the present invention.
Figure 8:
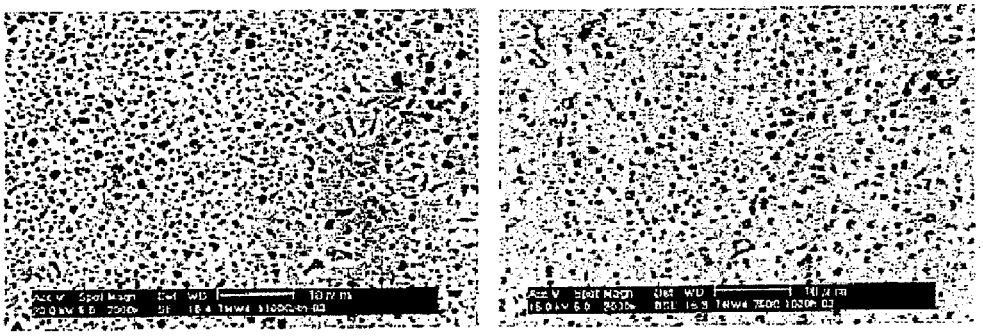
FIG. 8 gives photographs showing the microstructures of a rolled product of an alloy 3 embodying the present invention.

FIGS. 7 and 8 show the microstructures of the alloys 1 and 3 embodying the present invention, respectively, as obtained after holding tests conducted at 750° C. for 1,000 hours to ascertain their long-time phase stability. No harmful phase called the TCP phase is found, but it is obvious that the alloys of the present invention have a metallographic structure of very high stability.

Figure 9:
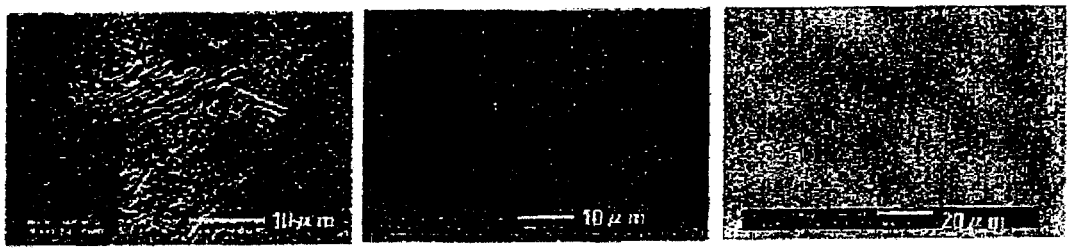
FIG. 9 gives photographs showing the microstructures of arc-melted ingots.

FIG. 9 shows the microstructures of arc-melted ingots of the alloys 7 and 8 embodying the present invention together with the structure of the comparative composition 25. No TCP phase is observed in the alloy 7 or 8, while a TCP phase is observed abundantly in the composition 25. It is obvious therefrom that the cobalt added to the alloys of the present invention realizes their excellent phase stability.

Figure 10:
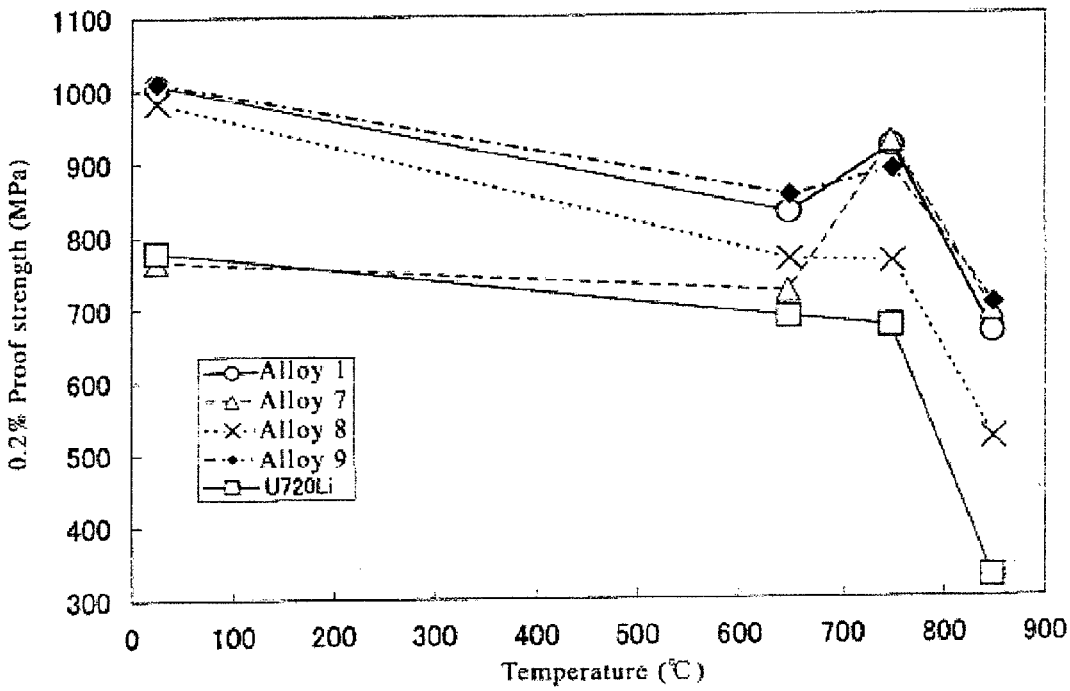
FIG. 10 is a diagram illustrating the results of tensile tests on arc-melted ingots.

FIG. 10 shows the results of compression tests conducted at various temperatures on test specimens taken from arc-melted ingots. It is obvious therefrom that the alloys embodying the present invention have a by far higher strength than that of the known U720LI at any temperature.

Table 4 shows the results of compression tests conducted at 750° C. on test specimens taken from arc-melted ingots of alloys embodying the present invention and not containing Mo or W and alloys embodying the present invention and containing Nb or Ta. It is obvious therefrom that all of the alloys embodying the present invention have excellent properties.

TABLE 4

| Alloy | 0.2% Proof Strength (MPa) |
|---|---|
| U720LI | 673 |
| Alloy 16 | 840 |
| Alloy 17 | 879 |

TABLE 4-continued

| Alloy | 0.2% Proof Strength (MPa) |
|---|---|
| Alloy 18 | 778 |
| Alloy 19 | 773 |
| Alloy 22 | 870 |
| Alloy 24 | 785 |

Industrial Applicability

According to the present invention, there is provided a novel heat-resistant superalloy for turbine disks and blades which are the critical parts of jet engines and gas turbines, as described in detail above. Although it has hitherto been considered that U720 exhibits the maximum high-temperature strength among the heat-resistant superalloys made by casting and forging and will not be surpassed by anything else, there is provided a heat-resisting superalloy surpassing it.

The invention claimed is:

1. A heat-resistant superalloy consisting in its composition of 12 to 14.9% by mass of chromium, 0.2 to 7% by mass of aluminum, 23.1 to 55% by mass of cobalt, from {0.17×(mass % of cobalt−23)+3} to {0.17×(mass % of cobalt−20)+7} % by mass of titanium, with the proviso that the composition consists of 6.1% or more by mass of titanium, optionally at least either 10% or less by mass of molybdenum or 10% or less by mass of tungsten, optionally at least either 5% or less by mass of niobium or 10% or less by mass of tantalum, optionally at least any of 2% or less by mass of vanadium, 5% or less by mass of rhenium, 2% or less by mass of hafnium, 0.5% or less by mass of zirconium, 5% or less by mass of iron, 0.5% or less by mass of carbon and 0.1% or less by mass of boron, and a balance of nickel and inevitable impurities, wherein the heat resistant superalloy is a cast and forged superalloy.

2. The heat-resistant superalloy as set forth in claim 1, wherein the molybdenum content is less than 4% by mass.

3. The heat-resistant superalloy as set forth in claim 1, wherein the tungsten content is less than 3% by mass.

4. The heat-resistant superalloy as set forth in claim 1, wherein the zirconium content is 0.05% or less by mass, the carbon content is 0.05% or less by mass and the boron content is 0.05% or less by mass.

5. The heat-resistant superalloy as set forth in claim 1, consisting in its composition:

12 to 14.9% by mass of chromium, 2.0 to 3.0% by mass of aluminum, 23.1 to 24% by mass of cobalt, 6.1 to 6.5% by mass of titanium, 0.8 to 1.5% by mass of tungsten, 2.5 to 3.0% by mass of molybdenum, 0.01 to 0.10% by mass of zirconium, 0.01 to 0.05% by mass of carbon, 0.01 to 0.05% by mass of boron, optionally at least either 5% or less by mass of niobium or 10% or less by mass of tantalum, optionally at least any of 2% or less by mass of vanadium and 5% or less by mass of rhenium, 2% or less by mass of hafnium and 5% or less by mass of iron, and a balance of nickel and inevitable impurities, wherein the heat-resistant superalloy is a cast and forged superalloy.

6. The heat-resistant superalloy as set forth in claim 5, wherein the heat-resistant superalloy is obtained by adding a $Co+Co_3Ti$ alloy to a heat-resistant superalloy having a $\gamma+\gamma'$ two-phase structure.

7. The heat-resistant superalloy as set forth in claim 6, wherein the $Co+Co_3Ti$ alloy is a Co+20 at % Ti alloy.

* * * * *